US007336203B2

(12) United States Patent
Arquette et al.

(10) Patent No.: US 7,336,203 B2
(45) Date of Patent: Feb. 26, 2008

(54) TRAFFIC CONTROL SYSTEM AND METHOD FOR USE IN INTERNATIONAL BORDER ZONES

(75) Inventors: Ann Arquette, Leamington (CA); Kathy Ouellette, Cottam (CA)

(73) Assignee: Border Gateways Inc., Kingsville, Ontario (CA)

( * ) Notice: Subject to any disclaimer, the term of this patent is extended or adjusted under 35 U.S.C. 154(b) by 328 days.

(21) Appl. No.: 10/948,997

(22) Filed: Sep. 24, 2004

(65) Prior Publication Data

US 2005/0073434 A1 Apr. 7, 2005

Related U.S. Application Data

(60) Provisional application No. 60/525,327, filed on Nov. 26, 2003.

(51) Int. Cl.
*G08G 1/065* (2006.01)

(52) U.S. Cl. ..... 340/928; 340/907; 701/117; 705/13

(58) Field of Classification Search ..... 340/917, 340/934, 907, 910, 928; 701/117; 705/1, 705/13, 404; 713/168; 212/271; 703/8; 209/552, 546
See application file for complete search history.

(56) References Cited

U.S. PATENT DOCUMENTS 3,686,627 A * 8/1972 Rubenstein ..... 340/928
3,794,966 A * 2/1974 Platzman ..... 340/928
5,310,999 A * 5/1994 Claus et al. ..... 235/384
5,424,727 A * 6/1995 Shieh ..... 340/928
5,798,714 A * 8/1998 Nyfelt ..... 340/988
6,166,659 A * 12/2000 Kusano ..... 340/928
2002/0082767 A1 6/2002 Mintz
2003/0004735 A1 1/2003 Dutta et al.
2003/0069738 A1 4/2003 Casey et al.
2003/0201907 A1 10/2003 Thompson et al.
2004/0054513 A1* 3/2004 Laird et al. ..... 703/8
2004/0091134 A1* 5/2004 Long ..... 382/104

* cited by examiner

*Primary Examiner*—Brent A. Swarthout
(74) *Attorney, Agent, or Firm*—Carrier, Blackman & Associates, P.C.; William D. Blackman; Joseph P. Carrier

(57) ABSTRACT

A traffic control system and method, for expediting traffic flow across international border crossings, includes a traffic control center and a virtual traffic lane. The traffic control center is spaced apart from the border crossing, and monitors traffic flow through a border zone. The traffic control center receives border-bound traffic, or electronic information from such traffic, and evaluates it to determine a vehicle's preparedness level. The traffic control center includes facilities for temporarily holding vehicles, and assists vehicles preparing to cross the border. The virtual traffic lane is a preferred route between the traffic control center and the border crossing, and is changeable depending upon traffic conditions. The virtual traffic lane is selected from a number of available monitored routes. The traffic control center monitors traffic conditions in the border zone, and determines which preferred travel route is most appropriate for selection as the virtual lane at any given time.

26 Claims, 7 Drawing Sheets

TRAFFIC CONTROL SYSTEM AND METHOD FOR USE IN INTERNATIONAL BORDER ZONES

CROSS-REFERENCE TO RELATED APPLICATIONS

The present application claims priority under 35 U.S.C. 119, based on Canadian patent application Serial No. 2,442,235, filed Sep. 24, 2003. The present application also claims priority under 35 U.S.C. 120, based on U.S. provisional application Ser. No. 60/525,327, filed Nov. 26, 2003. The complete disclosures of each of the referenced priority applications are hereby incorporated by reference.

BACKGROUND OF THE INVENTION

1. Field of the Invention

The present invention relates generally to traffic control systems and methods, and more particularly to a system and method for screening, tracking and managing vehicles bound for an international border, in an area near the border.

2. Background Art

Traffic control has been an issue for public and private roadways since the advent of motorized transportation. The issue of controlling traffic has been handled primarily through the use of signage, both stationary and electronic, without regard for the type or destination of the vehicle being controlled, or being given access to a particular roadway.

Conventional traffic signals placed, for example, on an approach route to a border crossing are generally passive and operate independently of traffic conditions. They are incapable of determining if, upon the changing of the light to green, all vehicles will actually be able to proceed through the border crossing. They are unable to consider a vehicle's level of preparedness to effect customs clearance, and can not consider the purpose of the border crossing, such as business or pleasure.

International border crossings must control traffic flow therethrough, and must also accommodate the special problems associated with this situation. For example, international border crossings require at least a cursory check of each vehicle and its contents, as well as a cursory check of the operator's documentation. A commercial vehicle, such as a tractor-trailer must also account for its cargo. A cursory inspection takes only moments, but during periods of heavy traffic flow, many small moments add up to long crossing delays.

Recent world events have increased security requirements, and thus necessitated more careful and thorough inspections at international borders, adding additional potential for traffic delays. Timely release by a customs service can only be effected in accordance with that customs service's clearance procedures and programs.

During periods of heavy traffic flow, traffic in the vicinity of a border crossing may back up into the adjoining area. Frequently this area is urban. Urban areas typically contend with heavy urban traffic flow, and thus, the additional traffic backing up from a border inspection station into the urban area can be catastrophic.

What is needed is a system and method for pre-screening and expediting selected vehicle releases at international border crossing(s), in order to minimize delays and ensure a level of preparation for the pre-screened vehicles, cargo, operators and passengers. Ideally, a system and method for pre-screening vehicles at border crossing(s) would enable timely release of vehicles by a customs service, at an official border crossing within a zone.

Automated traffic monitoring has been conducted for several years now, and been successful in determining roadway accessibility and conditions. Automated traffic monitoring continues to increase in sophistication over time, and improves the tracking of individual vehicles, cargo, operators and passengers. However, no system exists for tracking and observing, as separate entities within a border zone, only those vehicles, cargo, operators and passengers intending to cross into a foreign zone/territory. A commercial vehicle traffic operation center that operates in tandem with local and regional traffic management centers that monitor all vehicle traffic is part of a national Intelligent Transportation Systems network, and addresses the specific congestion and process issues in border zones.

In today's heightened need for border security, a need exists for highway planners to provide for road systems that allow for a monitored route to a border crossing, without having to disturb existing infrastructure or residences and businesses that rely on that infrastructure.

One possible solution would be to add an additional, separate, dedicated lane, designated exclusively for use by traffic approaching the international border crossing(s). However, this solution would require a large outlay of public or private funds, and would also necessitate a great disruption to drivers, business and local residents.

Many examples exist where roadway infrastructure in a zone leading to border crossings is decades old, and supports established residential and business interests. If the installation of a standard "bricks and mortar" type of dedicated lane was undertaken at such an established location, the costs of moving or dismantling existing infrastructure, and/or rerouting traffic through dedicated infrastructure, would be high.

What is needed is a method of maximizing route security for vehicles, cargo, operators and passengers, without requiring extensive changes to existing road or lane systems.

For the foregoing reasons, an improved traffic pre-screening and control system and method is needed, for expediting vehicular traffic across an international border, and for allowing border control personnel to track vehicles in a border zone.

SUMMARY OF THE INVENTION

The present invention provides an improved system and method for pre-screening and tracking vehicles headed towards international border crossing(s), in order to control traffic flow in a border crossing zone and the adjacent area. The improved system and method includes a traffic control center and a virtual traffic lane. The traffic control center is situated at a physical location that is spaced away from the border crossing(s), but that is still located within reasonable proximity to a border crossing or other high-volume traffic area. Vehicles, cargo, operators and passengers are routed through the traffic control center to be pre-screened and processed for travel through the zone near the border crossing(s), along the virtual traffic lane.

The traffic control center receives traffic and information about approaching traffic en route to the border crossing(s), and separates this traffic into first and second traffic streams. A first traffic stream includes vehicles that are prepared to cross an international border, and a second traffic stream includes vehicles that are unprepared to cross the international border.

Vehicles that are considered to be prepared are directed through an automated lane with a red-light, green-light control, that permits continuum of travel for vehicles that have confirmed prepared status. This stream of traffic is described as "Fast-On-The-Fly" lane traffic flow and operates as a physical merge lane adjacent to the highway lanes. Vehicles in the "Fast-On-The-Fly" lane are allowed to proceed to the border in the virtual traffic lane.

Vehicles that are considered to be unprepared are redirected to a staging area in the traffic control center, where they are assisted in becoming prepared, and where they have access to other travel services. Once the unprepared vehicles have remedied their deficiencies to become ready for the border crossing, they are then added to the queue and allowed to proceed to the border in the virtual traffic lane.

The virtual traffic lane is a vehicular roadway, or a combination of roadways, that lead from the traffic control center to the border crossings, or through the high-volume areas. The virtual traffic lane is the preferred roadway or combination of roadways between the traffic control center and the border crossing(s), and is selected from a plurality of preferred routes.

Each of the preferred local border traffic routes includes a series of traffic monitoring stations, where the monitoring stations are provided periodically along the route to allow monitoring and analysis of the traffic conditions along each route, and also to allow tracking of specified pre-screened vehicles within the route.

The virtual traffic lane consists of a specified travel route for a period of time, and then may be changed to an alternative roadway or series of roadways, as determined by travel conditions within all possible preferred routes. The virtual traffic lane is thus variable, and is dependent upon real time traffic conditions on many roadways within the border zone. The virtual traffic lane uses existing infrastructure, but selects and prioritizes traffic routes within the existing infrastructure based on traffic volume, the type of traffic using the roadways, immediate traffic conditions, the time of day, and other factors which affect traffic flow.

The inventive system monitors the traffic moving along preferred local border traffic routes, and shifts approved vehicles onto the best available route, that is, the presently designated virtual traffic lane, to the border crossing(s).

Once vehicles, cargo, operators and passengers are cleared for passage by the traffic control center, they are able to move in an orderly manner between the traffic control center and the border crossing(s), and to cross the border distinct from other vehicular border traffic. The pre-screened vehicles are separated from other vehicles, either by physical barriers or by a selected electronic designation, which identifies the pre-screened vehicular traffic as being previously processed for the border crossing(s). Such approved vehicular traffic thus minimizes or avoids delays in long queues much nearer to the border crossing, and helps to reduce local traffic congestion in a zone close to the border.

The improved traffic control system and method according to an embodiment of the invention also relates to a system for routing local traffic, bound for the border crossing, within the border zone. Pre-registered vehicles, cargo, operators and passengers with a point of origin within the border zone report electronically to the traffic control and preparation center.

After verification, the center notifies the vehicle operator that all documents are in order, indicates to the vehicle operator that departure from the center is approved and provides a specified time and route for the vehicle to use in approaching the border crossing, for example, the virtual traffic lane. The vehicle then proceeds to the border crossing, crosses the border, and then travels to its destination beyond the border.

The traffic control center provides screening of incoming traffic to determine preparedness for crossing the border. Traffic proceeds from the screening area either to a border queue or to a preparation remediation center. Once proper preparation has been achieved, vehicles from the preparation remediation center also proceed to the border queue. The traffic control center also includes a traffic control system which receives input from all of a local traffic monitoring system (Traffic Operation Center, TOC), a regional traffic center, and the virtual lane monitoring system, and uses this information to provide efficient vehicle sequencing, route selection, and traffic flow control.

The improved traffic monitoring and control system and method according to another embodiment of the invention provides a staging area within the traffic control center for inbound, border-crossing vehicles, cargo, operators and passengers, where they may be checked for properly prepared documentation for pre-approval to cross the local border crossing. Those vehicles, cargo, operators and passengers that do not have proper documentation will be assisted in obtaining or filling out proper documentation to achieve prepared status.

The improved traffic monitoring and control system and method hereof also provides for reduced traffic backups on the roads and highways leading to the border crossing(s), allowing local traffic to move more freely and safely. By reducing or preventing long lines of vehicles idling and slowly moving to the border crossing(s), the system and method according to the present invention improves the local environmental quality standards, improves the quality of life of drivers, and saves fuel and other resources.

The improved traffic monitoring and control system and method according to the present invention also provides an opportunity for Emergency Operations planning and business recovery in the event of an emergency affecting the border zone. Vehicles in the staging area are stationary, and their engines may be turned off during the inspection and queuing for release periods, saving fuel, tire and brake wear, and allowing the operators to rest and reduce fatigue.

The present invention also provides for additional services to be provided at the staging area related to transport and traffic, such as fuel depots, truck wash, scales, vehicle service, accommodations, restaurants, gift shops and the like.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1A:
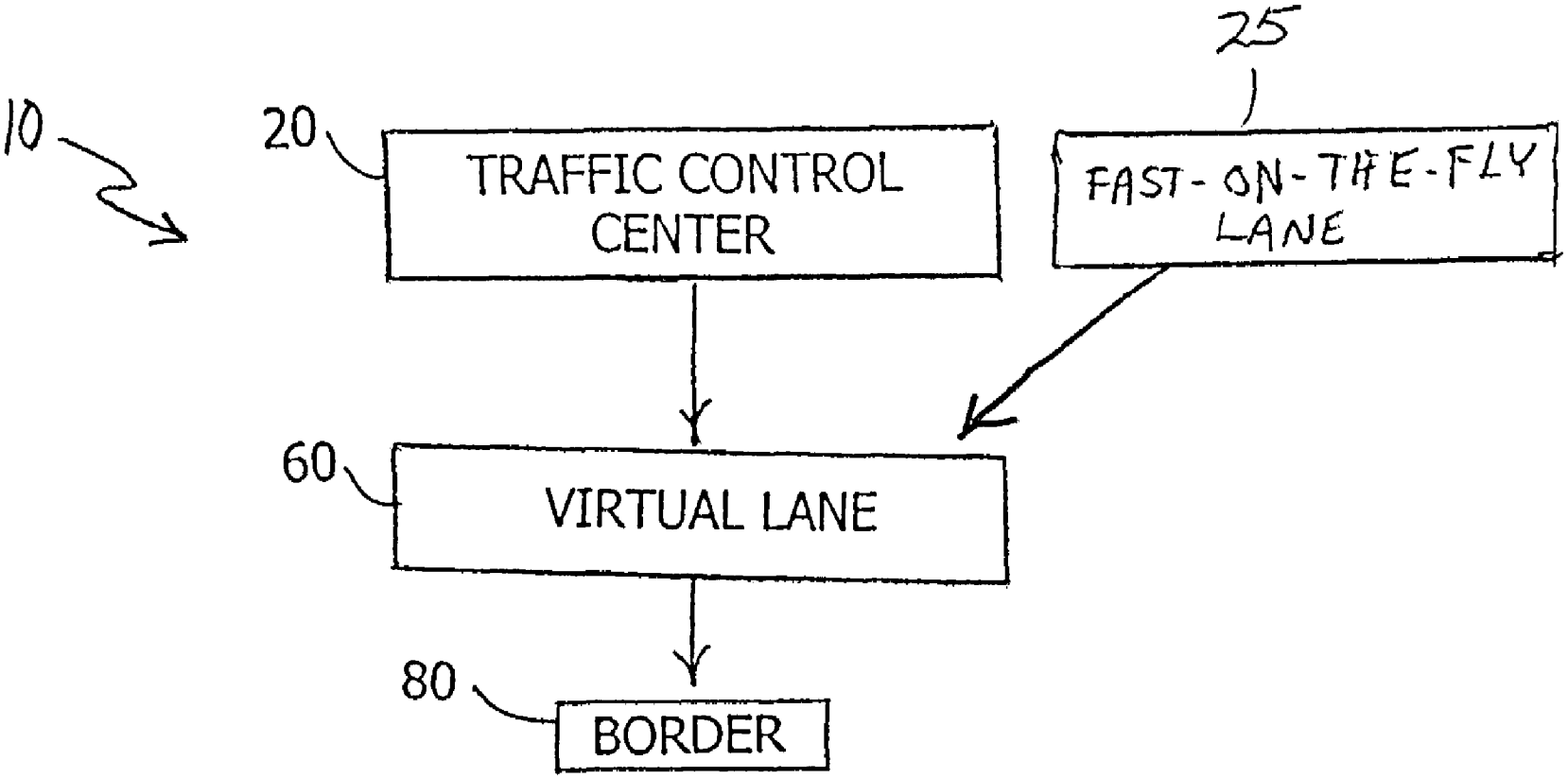
FIG. 1A is a schematic diagram illustrating three main components of the traffic control system hereof, including the traffic control center, the fast-on-the-fly lane, and the virtual lane.

An improved system and method for pre-screening and tracking vehicles, and controlling traffic flow in a border crossing zone according to an illustrative embodiment of the present invention will now be described with reference to the figures. As shown in FIG. 1A, the inventive traffic control system 10 includes a traffic control center 20, a Fast-On-The-Fly merge lane 25 (expedited clearance lane) adjacent to the Traffic Control Center 20, and a virtual traffic lane 60 that extends between the traffic control center and a border 80. In this system, traffic approaching the border 80, and passing through the zone from an origin which is remote, or non-local in relation to the border zone, should proceed either through the traffic control center 20 or through the Fast-On-The-Fly automated merge lane, and then should subsequently move through the virtual traffic lane 60.

The traffic control center 20 comprises both a "bricks and mortar" facility that receives vehicle traffic therethrough, and a traffic control data management system that maximizes traffic flow rate through the traffic control center 20 and the virtual traffic lane 60.

The Fast-on-The-Fly Lane 25 includes a physical merge lane adjacent to the highway lanes en route to the border 80. This lane 25 is equipped with elecronic monitoring equipment, which may include transponder reader and closed-circuit television (CCTV) equipment, and is physically controlled with red-light, green-light signals and corresponding access gates. International traffic approaching the zone, which has transmitted information confirming proper prior F.A.S.T. (Free And Secure Trade) preparation status, will be able to pass through this lane without coming to a full stop at the traffic operation center.

The Traffic Control Center 20 will receive data about the incoming vehicle via transponder or other approved signals, and provide a green light for advance of F.A.S.T. approved prepared vehicles, operators and cargo, and a red light for those with incomplete or no preparation status.

A turn lane into the Traffic Control Center will be provided for red light signals to provide preparation assistance to non-prepared vehicles, operators and cargo. A green light signal will provide continuum of movement into the virtual lane 60 to the border 80. A red light will be signaled for all traffic in this lane in the event of an emergency or other roadway event that prohibits access to the virtual lane 60.

The traffic control center 20 is located spaced apart and physically distant from the border 80 and border inspection facilities 84. The distance between the traffic control center 20 and the border 80 is dependent upon the existing infrastructure and demographics of the zone adjacent the border 80. In the illustrative example wherein a border 80 is located adjacent to an urban area 90, a preferred location for the traffic control center 20 is such that it resides outside of and adjacent to the urban area 90, with at least a portion of the urban 90 area lying between the traffic control center 20 and the border 80.

Locating the traffic control center 20 at a physical location spaced away from the actual border 80 is beneficial for several reasons.

Typically, there is available space at locations apart from the border 80 that can be used for the infrastructure required for accommodating, inspecting, sorting, and channeling large numbers of vehicles.

In addition, traffic congestion associated with the border inspection process and operations is physically removed from the border itself and the urban area 90 to a large extent, thus minimizing its negative impact on these communities.

Finally, the physical separation of the traffic control center 20 from the border 80 provides an area of traffic flow, between the traffic control center 20 and the border 80, that can be managed. This managed area is the virtual traffic lane 60.

Traffic Control Center

Figure 2:
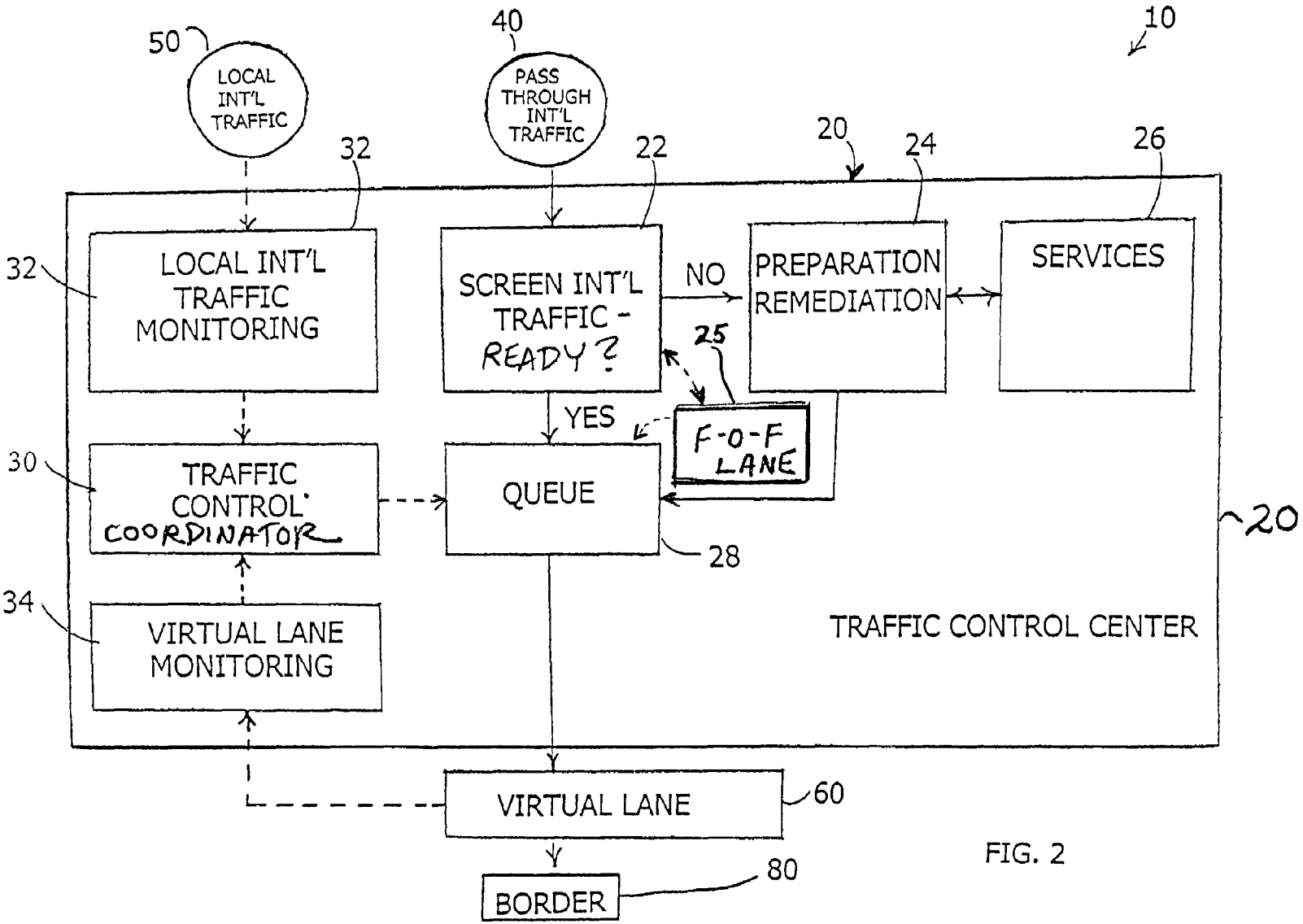
FIG. 2 is a schematic diagram illustrating relationships between components of the traffic control center hereof, wherein traffic flow is indicated using solid lines, and flow of electronic information is indicated using broken lines.

The traffic control center 20 will now be described with reference to FIG. 2. The traffic control center 20 receives traffic heading toward the urban area 90 and bound for the border 80. Specifically, commercial vehicles, cargo, operators, and passengers who have an origin outside of the local zone adjacent to the border 80, and who intend to cross the border, must enter the traffic control center 20, or else must provide information in advance to access the Fast-On-The-Fly Lane 25. In particular, the system and method hereof is suited for pre-screening and monitoring cargo-hauling over-the-road semi truck traffic.

Upon entry into the traffic control center 20, the traffic is inspected, and prepared for border crossing within the screening component 22 of the traffic control center 20. This initial screening may be performed electronically and/or through human interface.

Electronic determination of the vehicle's level of preparedness to cross a border can be achieved through automated systems such as the reading of radio frequency identification (RFID) tags or transponders on the vehicle itself, ASN (Automated Shipping Notification) transmitted by shipper/carriers or on an operator/occupant identification card.

Human interface screening can be achieved through an interview with the operator and/or passengers and the review of pertinent documentation, and may include information provided by a customs broker or shipper of cargo.

The screening component 22 separates the traffic into at least two, and possibly into three traffic streams.

The first traffic stream is an expedited clearance route (Fast-on-the-Fly Lane) for those having F.A.S.T. certification status, having provided advance notification of same to the Traffic Control Center.

The second traffic stream is designated for prepared vehicles who have not been F.A.S.T. certified in advance, but who are nevertheless ready for border crossing; that is, vehicles, cargo, operators and passengers which are in possession of the proper documentation, including appropriate customs information, for crossing an international border and which otherwise meet the legal requirements for crossing the border.

The third traffic stream is designated for vehicles who are not yet fully prepared to cross the border, because of some deficiency.

Prepared vehicles which have F.A.S.T. certification, having provided advance arrival notice, can move through the Fast-on-the-Fly Lane 25. These pre-screened vehicles are cleared electronically, and are automatically placed into an electronic queue by a queueing component 28, then schedules the release of these vehicles into the virtual traffic lane 60 when sequencing permits.

Prepared vehicles following the second traffic stream are electronically and/or manually checked to confirm their prepared status, and are directed to the queuing component 28 within the traffic control center 20. The queuing component 28 then schedules the release of these vehicles into the virtual traffic lane 60.

Unprepared vehicles following the third traffic steam are directed to a preparation remediation component 24 within the traffic control center 20. The preparation remediation component 24 receives vehicles that do not have possession of the proper documentation for crossing a border, or who have other deficiencies which prevent them from crossing a border, and includes a physical staging area, wherein such vehicles can be temporarily stopped. The preparation remediation component 24 includes personnel and facilities to assist in remedying the deficiencies in customs information and/or other requirements.

Subsequent to this assistance, and when the vehicles within the preparation remediation component 24 overcome their deficiencies, and are deemed to be prepared to cross the border, the preparation remediation component 24 directs the vehicle to the queuing component 28. The queuing component 28 then schedules the release of these vehicles into the virtual traffic lane 60.

The preparation remediation component 24 also provides ancillary services 26 for vehicles within the staging area. Ancillary services 26 are related to travel and transportation, and may include, but are not limited to, services such as a fuel depot, vehicle repair, restaurants and lodging, retail, truck scales, truck wash and the like.

By providing a staging area within the preparation remediation component, long lines of vehicles idling and slowly moving to the border crossing(s) are reduced or prevented. Because vehicles can be shut off within this area, the local environmental quality standards are improved, the quality of life of drivers and occupants is improved, and fuel and other resources are saved. Vehicles in the staging area are stationary, and their engines may be turned off during the inspection and queuing for release periods, saving fuel, tire and brake wear, and allowing the operators to rest and reduce fatigue.

The staging area within the preparation remediation component 24 allows for vehicle traffic to be released from the center grounds according to a vehicle's level of preparedness, reflecting the ability of the vehicle to quickly arrive at the border and effect the actual border crossing(s). As a result of the pre-screening which takes place at the traffic control center 20, and communication to the border patrol personnel of information about the pre-screened status of specified vehicles, and their place in the queue, moving these pre-screened vehicles across the actual border 80 can be expedited. As a result, the waiting time for vehicles at the border can be reduced significantly.

In so doing, operators, passengers, and transport companies will have a better awareness of the time required to cross the border, resulting in a stabilization of shipping schedules. Timing is particularly crucial in today's shipping methods, including "just in time" component delivery for manufacturing processes, or other custom critical shipping methods.

The traffic control center 20 also includes a traffic control coordinator 30, which includes software and databases relating to traffic analysis, routing, and control, customs information, vehicle tracking information, etc. The traffic control coordinator 30 receives, analyzes and stores data from the screening component, the virtual lane monitoring system, local and regional traffic monitoring systems, and carriers and shippers providing electronic advance shipping notices. Computer software is used to integrate this data into the system, and to allow maximally efficient control of traffic to the border crossing(s) via control of traffic flow rate and routing.

The queuing component 28 receives prepared traffic from all of the first second and third traffic streams. The queuing component 28 provides sequential ordering of prepared vehicles for advancement to the virtual traffic lane 60 and, based on information received from the traffic control coordinator 30, schedules their release into the virtual traffic lane 60. Queuing will occur electronically, based on vehicle and operator preparedness to effect customs release at the intended port of crossing.

Release time into the Virtual Lane 60 will then be based on road conditions between the authorized point of origin and the official border crossing(s). Vehicles within the queuing component 28 will receive authorization to leave the grounds of the traffic control center 20. This authorization can be communicated in known ways, which include, but are not limited to, via pagers previously distributed at the entrance to the traffic control center 20, via other radio communications means, by an electronic signboard, or by a traditional red light/green light indicator.

If desired, information about pre-screened vehicles acquired by the traffic control coordinator 30 may be shared between the border patrol and other governing agencies on both sides of the border 80.

Locally Originating Border-Bound Traffic

The traffic control center 20 also monitors and controls the traffic flow of locally originating border traffic 50, including commercial vehicles, cargo, operators and passengers that originate within the border zone, such as the area between the traffic control center 20 and the border 80.

For example, locally-based vehicles that cross the border on a regular basis are allowed to pre-register with the traffic control center authority, and data corresponding to these pre-registered local vehicles is stored in the database of the traffic control coordinator 30.

Figure 3:
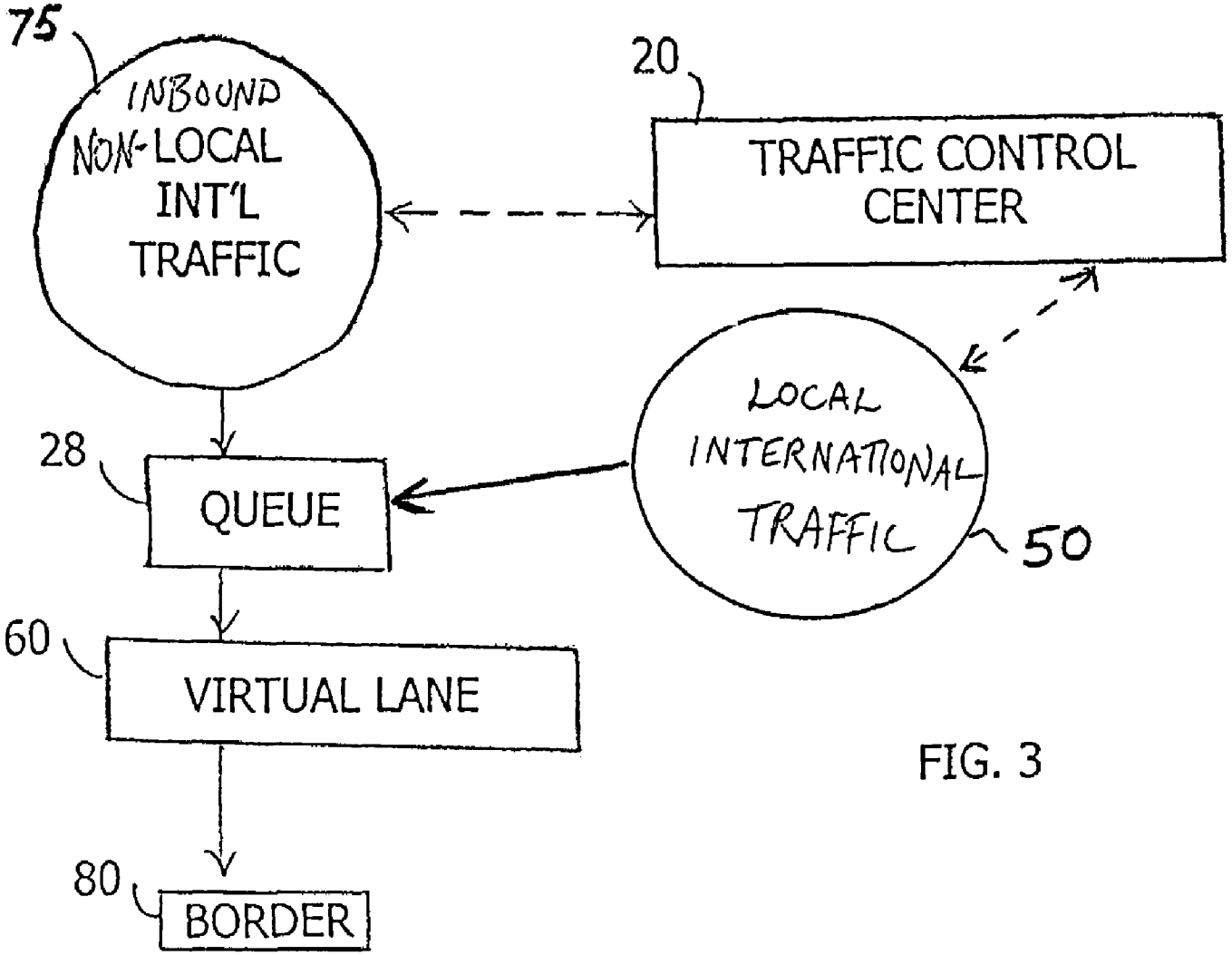
FIG. 3 is a schematic diagram illustrating the portion of the traffic control system hereof used to route traffic that is bound for the border crossing.

Referring now to FIG. 3, pre-registered locally-based vehicles 50 may report in person to the traffic control center 20, or may report only electronically to the traffic control coordinator 30. Since these vehicles are pre-approved, they are not required to physically report to the traffic control center 20. However, local vehicles who wish to cross the border and who are not pre-registered may proceed to the traffic control center 20, or may electronically provide required information and documentation to achieve prepared status, prior to approaching the border 80.

In one embodiment hereof, pre-registered vehicles report only electronically to the traffic control coordinator 30, using communications means such as telephone or fax transmission, or a notification system similar to a paging system.

The traffic control coordinator 30 will then accept these electronic reports of preparedness, providing that the vehicles are pre-registered and that the reports meet the appropriate guidelines, and the traffic control coordinator will remotely release the corresponding vehicles to the queuing component 28 for scheduling in the virtual traffic lane 60 and a subsequent border crossing. This aspect of the present invention simplifies border crossings for local traffic, which can be a sizeable percentage of daily traffic volume through the border 80.

Locally originating F.A.S.T. Certified Inbound International Traffic may also report electronically to the Traffic control coordinator 30, and may be automatically queued for access into the Virtual Lane 60, in an appropriate sequence.

Traffic proceeding from the traffic control center 20 through the urban area 90 and to the border 80 uses the virtual traffic lane 60. The system provides a "virtual" or electronically monitored lane to monitor vehicle movement in order to provide for the secure movement of vehicles, cargo, operators and passengers to a border 80, and creates a related database of resulting monitoring information.

Traffic proceeding from the traffic control center 20 moves toward the border 80 on the virtual traffic lane 60, crossing the border on an expedited basis, since process preparedness has taken place and status determination is not normally required at the actual customs checkpoint 84 for vehicles that have been cleared by the traffic control center.

An exception to this would be an additional inspection of a vehicle that did not remain reasonably within the correct sequence while in the virtual traffic lane 60, or which displayed other unexpected changes between the traffic control center 20 and the border 80, such as a sudden change in vehicle weight or route delay or diversion.

In one embodiment of the present invention, multiple preferred traffic routes between the traffic control center 20 and the border 80 are established, and each of these preferred routes is equipped with monitoring systems as described above. These routes are made up either partially or completely of existing private or public roadways. Based on information received about traffic flow within these multiple preferred routes, the single best route is identified for a given time. This identification is determined based on real-time traffic conditions, security needs, and other factors. This best route is selected as the virtual traffic lane 60 for a particular vehicle.

Upon a change in traffic conditions within the virtual traffic lane 60 or within other preferred traffic routes, a new best route may be determined, and the specific route used for the virtual traffic lane 60 may be changed accordingly. By monitoring multiple preferred traffic routes, the best route can be determined at any given time.

Virtual Traffic Lane

Figure 1B:
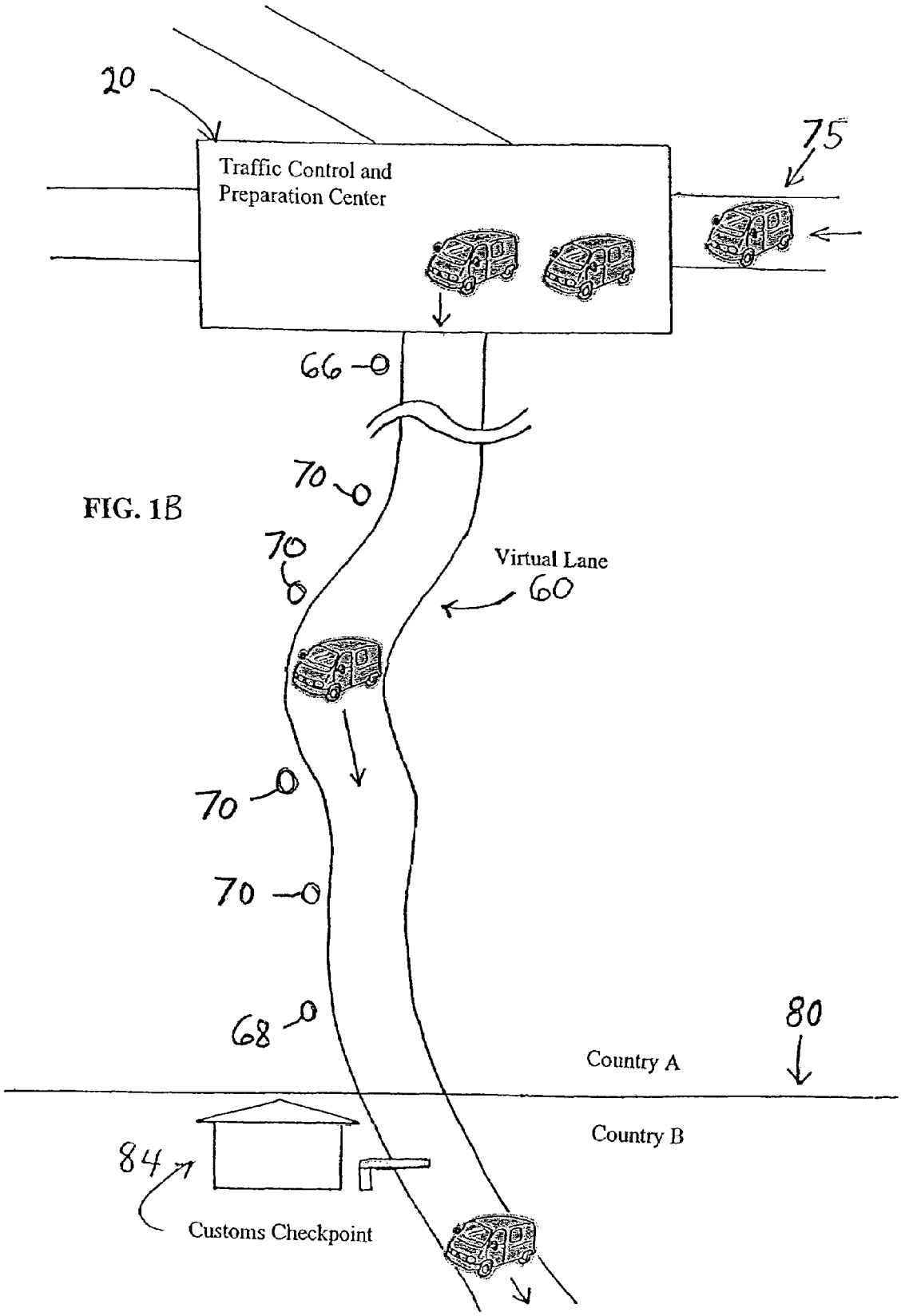
FIG. 1B is a schematic diagram illustrating one example of a virtual lane.
Figure 4:
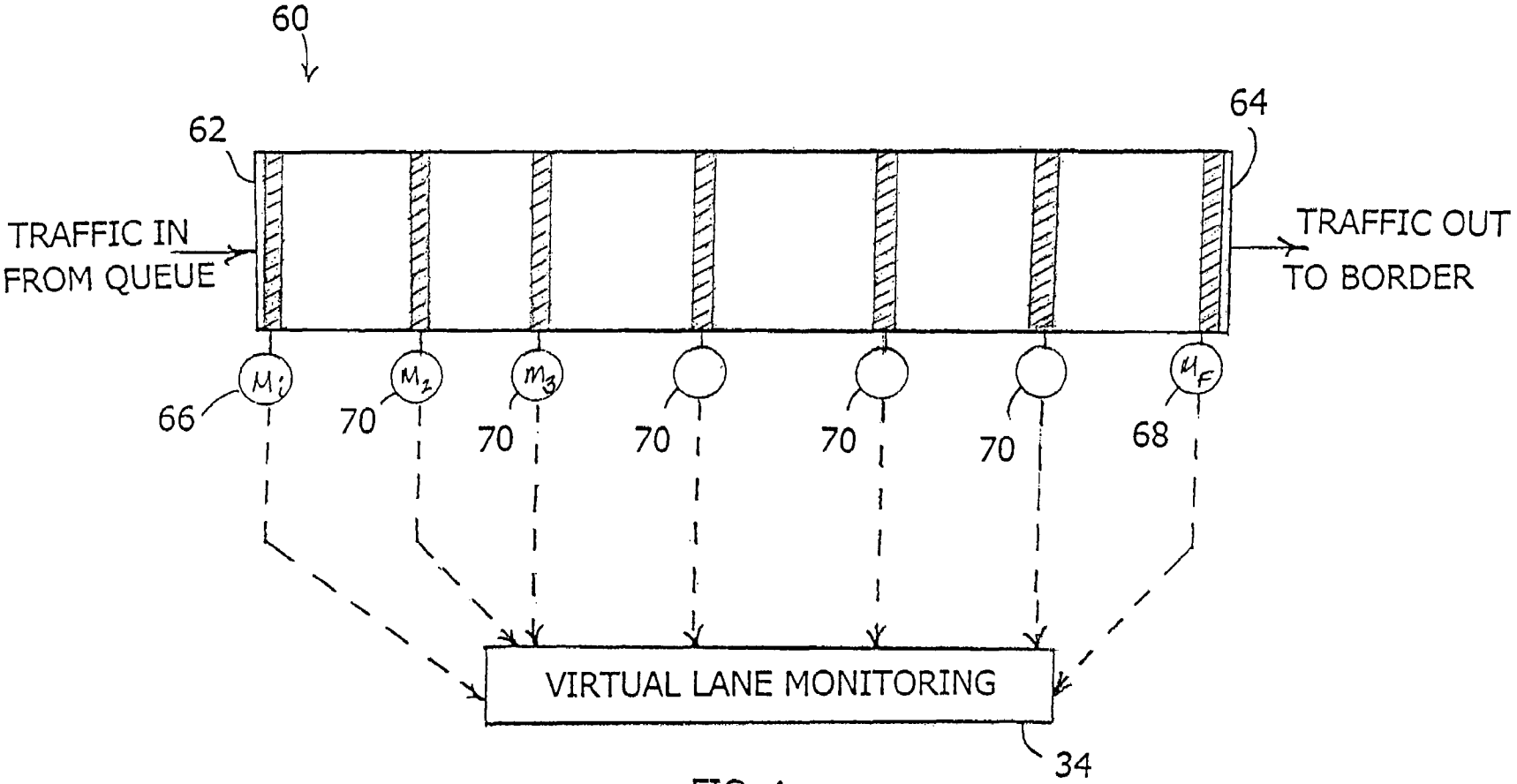
FIG. 4 is a schematic diagram of a virtual traffic lane and its monitoring system according to another embodiment of the present invention.
Figure 5:
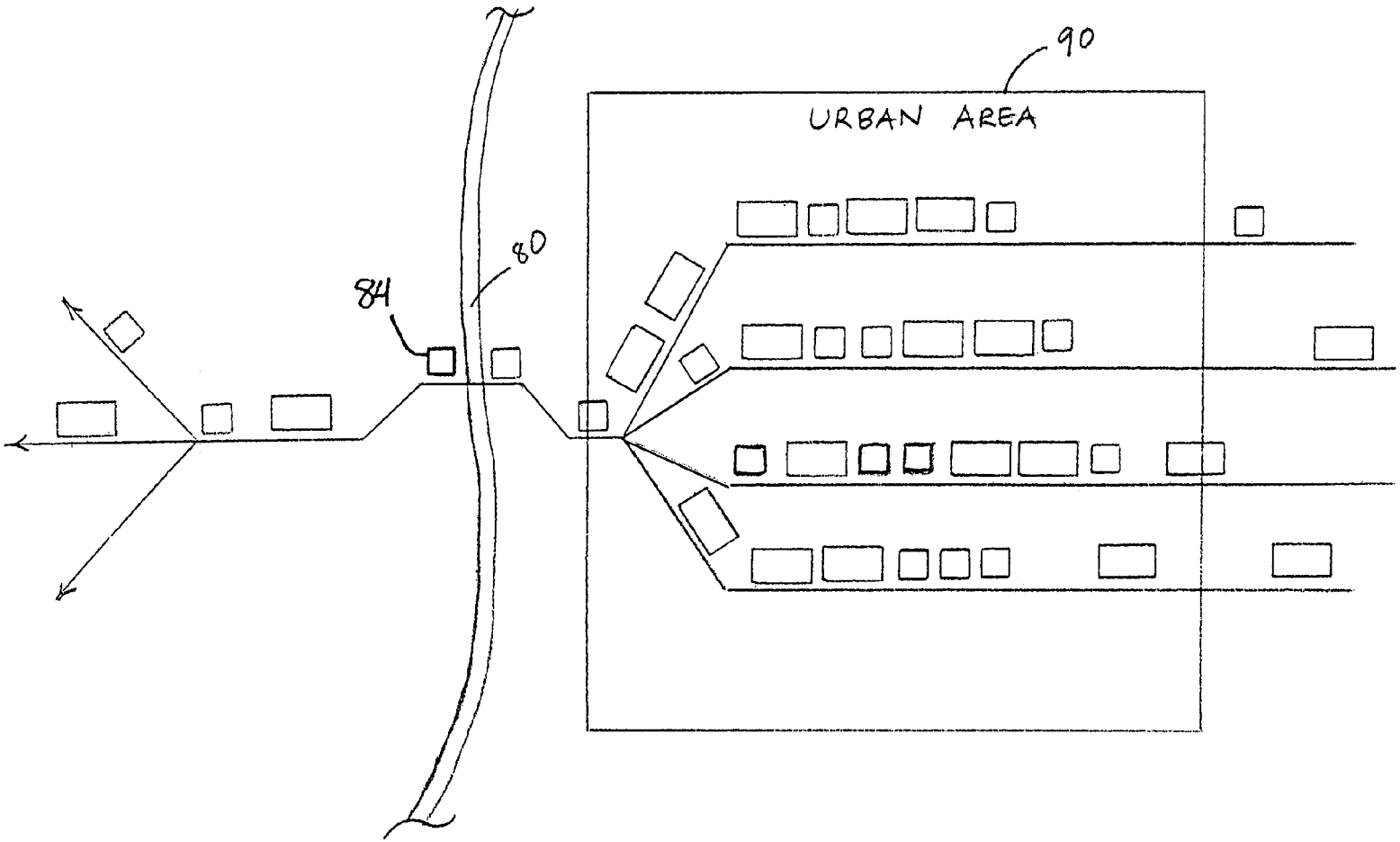
PRIOR ART FIG. 5
FIG. 5 illustrates a prior art border crossing and border crossing zone illustrating the effect of traffic congestion at the border crossing on the adjacent urban area.
Figure 6:
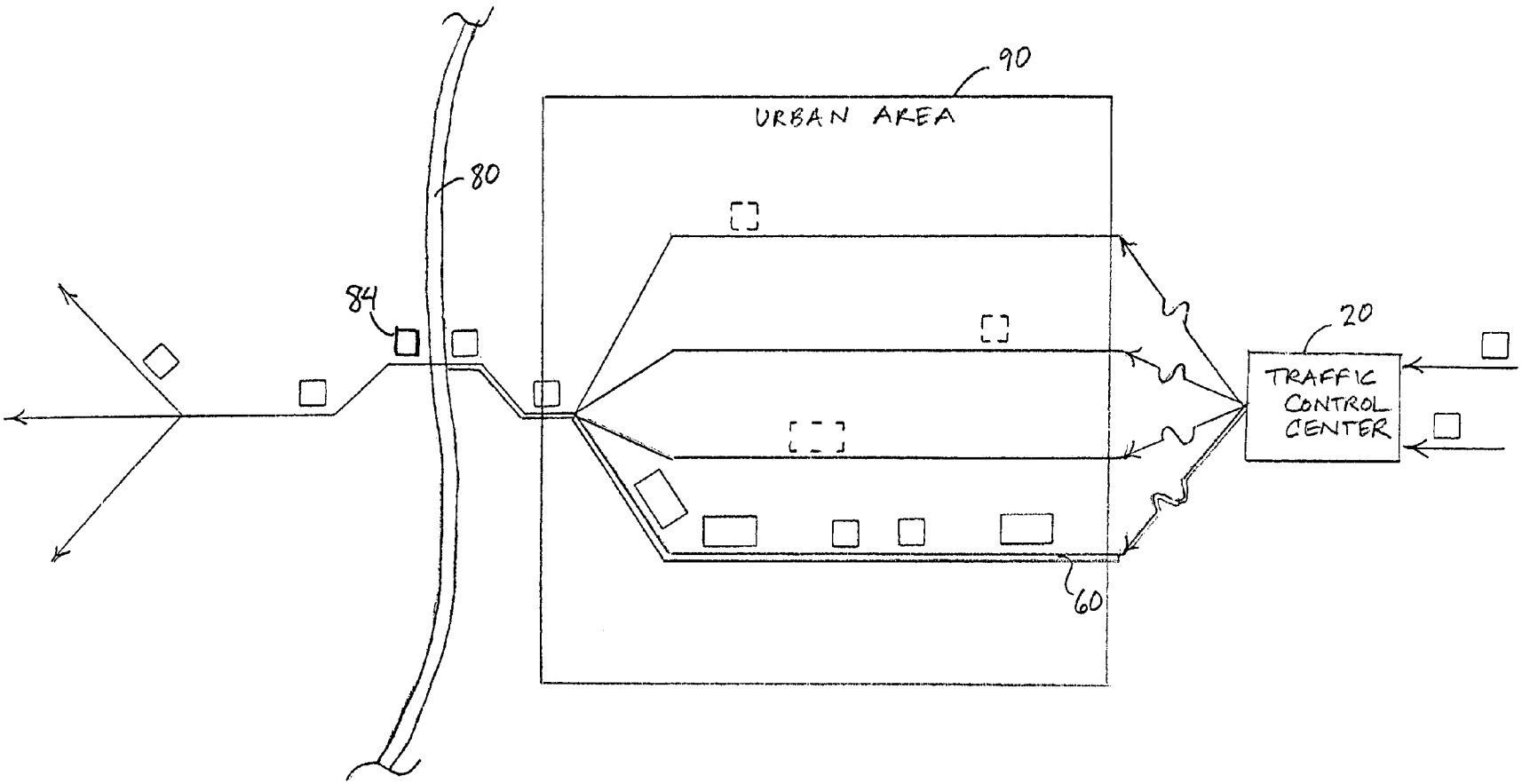
FIG. 6 illustrates an expedited border crossing within the border crossing zone, and also illustrates one possible location for the traffic control center within the border crossing zone, according to the present invention.

The virtual traffic lane 60 includes one or more roadways through the urban area 90, and includes a plurality of spaced-apart sequential monitoring stations such as those shown at 66, 68, and 70 in FIGS. 1B and 4. In one exepmplary embodiment hereof, an initial monitoring station 66 is positioned at the inlet 62 to the virtual traffic lane 60, and a final monitoring station 68 is positioned at the exit 64 from the virtual traffic lane 60, where the exit 64 from the virtual traffic lane is located at the entrance to the border 80. A plurality of intermediate monitoring stations 70 may be provided between the initial monitoring station 62 and the final monitoring station 64.

Each of the individual monitoring stations 66, 68, 70 relays real-time information to the traffic control coordinator 30, which collects information about the vehicles as they proceed from the traffic control center 20 to the border 80. Information collected may be from one or more modes of data output.

The information may be visually obtained, such as through a video camera system, and include information such as an image of a vehicle, a license number of the vehicle, the number of vehicle occupants, the appearance of vehicle and cargo, and/or an image of the driver. Alternatively, vehicle information may be picked up via a radio transponder.

Other information may be obtained from one or more types of sensors. Sensor information may include vehicle speed, vehicle weight, time of passing a site, vehicle sequence order in queue, whether the vehicle's sequence order in queue has changed since last monitoring station or entry into lane, and whether a vehicle is following the specified route.

Other information may be obtained using electronic communications such as a radio frequency identification tags, global positioning sensors, and/or a reader which reads electronic information from the vehicle, such as license plate number, a unique identification number associated with a personal or vehicle data file, or cargo/manifest information. However, monitoring of virtual traffic lane 60 is not limited to these technologies. Other suitable technologies that are appropriate for the purpose of monitoring traffic may be used to provide surveillance.

Vehicle sequence monitoring is a method of monitoring changes to cargo or passengers between the traffic control center 20 and the border 80. The sequence of approved vehicles, as determined by the queue 28 within the traffic control center 20, is checked at each monitoring station 66, 68, 70.

If any particular vehicle drops back significantly in the assigned sequence, operators of the traffic control system 10 are alerted. The Traffic Control Operator may view that vehicle via CCTV and provide the electronic "flag" of that event, for possible re-inspection when it reaches the border. A large and unexpected change in vehicle queue sequence may indicate that a vehicle has temporarily stopped or detoured, and may have altered the vehicle contents, or engaged in other questionable activities. While the driver of the vehicle may have a good explanation for the change in vehicle sequence, it is also possible that the driver of the vehicle which has dropped back in the queue sequence has been engaging in illicit behavior, such as adding contraband to the vehicle, substituting one type of cargo for another, or changing personnel in the vehicle.

The individual monitoring stations 66, 68, 70 also provide information to the traffic control coordinator 30 regarding traffic flow through the virtual traffic lane, and is used to determine the optimal route to the border 80 at any given time.

Information from the monitoring stations is directed to the traffic control coordinator 30, where portions of it may be stored for later reference, and where it is used, along with information from the local traffic monitoring, to analyze traffic patterns and control traffic flow rates and pathways through or around the urban area 90 via the traffic queue 28 and virtual lane 60.

Drivers will advise route of preference to border crossings and will receive relevant information about access availability to their specified route. Once a determination of preferred route has been made, a Traffic Control Center Operator will advise the driver about which route his/her dispatch applies to. This will be provided at the time the queuing position is advised.

Prior to being released from the traffic control center, and prior to entering the vehicle traffic lane, and simultaneous with receiving authorization to leave the grounds of the traffic control center, vehicles may be provided a printed map showing the virtual traffic lane to which the vehicle has been assigned.

Alternately, each preferred traffic route may be assigned and marked with a unique color or number code, and the code corresponding to the virtual traffic lane 60 may be provided to a vehicle driver, with the authorization to leave the grounds of the traffic control center.

In another alternate embodiment, communication of route information may include an electronic download of driving instructions directly to a vehicle's computer system.

Method

One example of a method of using the inventive traffic monitoring and control system 10 will now be described for the illustrative example wherein an international border 80 is located adjacent an urban area 90, and wherein the traffic congestion associated with inspection delays at the border 80 extend into the urban area 90, and must therefore be mitigated.

The method includes using the traffic control system 10, including the traffic control center 20, the traffic control coordinator 30, and virtual lane 60.

A first illustrative embodiment of a method according to the present invention consists of the following method steps:

a) communicating between selected border-bound traffic and a traffic control center 20 which is remotely spaced apart from an international border 80;

b) determining whether individual vehicles are prepared to cross the border according to a set of guidelines, and sorting the vehicles into prepared and unprepared vehicles; arranging a series of the prepared vehicles into a queue;

c) directing the prepared vehicles in the queue to travel along an assigned route defining a virtual lane 60;

d) monitoring the prepared vehicles as they travel along the virtual lane 60, using a plurality of monitoring stations 66, 68, 70; and providing information about the prepared vehicles in the queue to a border crossing authority.

A second illustrative embodiment of a method according to the present invention consists of the following method steps:

Step 1. Monitor traffic flow through the urban area 90 via multiple predetermined traffic routes between the traffic control center 20 and the border 80. The predetermined traffic routes are continuously monitored using plural monitoring stations 66, 68, 70 disposed along each route.

Step 2. Relay monitored information to the traffic control coordinator 30 within the traffic control center 20.

Step 3. Determine the best route at a specific time and establish it as the virtual traffic lane 60 for that time. The determination is made using real-time information about current roadway conditions as reflected in the input data received from the monitoring stations 66, 68, 70, anticipated traffic load, weather conditions, road construction, and any other pertinent information.

Step 4. Receive traffic bound for the border 80 within a traffic control center 20 that is physically located reasonably near the urban area 90, yet spaced at a distance away from the border 80 and its associated customs checkpoint 84. The traffic control center 20 is positioned such that at least a portion of the urban area extends between the traffic control center 20 and the border 80.

Step 5. An initial screening of vehicles is provided at the traffic control center 20 using the screening component 22, in which the traffic is inspected, and evaluated for preparedness for border crossing.

Step 6. The screening component 22 separates the traffic into three traffic streams. The first traffic stream is provided for those with F.A.S.T. certification status who have provided advance arrival notice to the Traffic Control Center and wish to use the Fast-On-The-Fly merge lane adjacent to the Traffic Control Center. The second traffic stream is designated for prepared vehicles, that is, vehicles, cargo, operators and passengers which are in possession of the proper documentation, including appropriate customs information, for crossing an international border and otherwise meet the legal requirements for crossing the border, but who have not pre-registered with the F.A.S.T. System. The third traffic stream is designated for vehicles who are not yet fully prepared to cross the border, because of some deficiency.

Step 7A. F.A.S.T. Certified vehicles, operators and cargo having provided advance arrival notification follow the first stream into the merge highway lane adjacent to the Traffic Control Center. The entry of these vehicles into the Virtual Lane 60 signals that vehicle input into the traffic queuing component 28.

Step 7B. Prepared vehicles following the second traffic stream are directed to a queuing component 28 within the traffic control center 20.

Step 7C. Unprepared vehicles following the third traffic steam are directed to a preparation remediation component 24 within the traffic control center 20. The preparation remediation component 24 receives vehicles that do not have possession of the proper documentation for crossing a border, or who have other deficiencies which prevent them from crossing a border, and includes a physical staging area wherein vehicles can be temporarily stopped. The preparation remediation component 24 includes personnel and facilities to assist in remedying the deficiencies in customs information and/or other requirements. Subsequent to this assistance, and when a vehicle within the preparation remediation component 24 is deemed to be suitably prepared to cross a border, the preparation remediation component 24 directs the vehicle to the queuing component 28.

Step 8. The queuing component 28 then schedules the release of prepared vehicles into the virtual traffic lane 60.

Step 9. Traffic enters the virtual traffic lane 60 at the virtual traffic lane inlet 62, and is surveyed by the inlet monitoring station 66. Monitored information is relayed to the traffic control coordinator 30, where it is both stored and used for traffic analysis and control purposes. Inlet vehicle sequence within the flow of traffic is established and stored within machine memory.

Step 10. Traffic proceeds along the virtual traffic lane 60 and is surveyed by at least one intermediate monitoring station 70. In the embodiment of FIG. 4, virtual traffic lane 60 includes a plurality of intermediate monitoring stations 70. In one particular embodiment, an intermediate monitoring station is provided at regularly spaced intervals, such as at every kilometer, at major intersections, and/or at discontinuities in the type of roadway.

Monitored information is relayed to traffic control coordinator 30, where it is both stored and used for traffic analysis and control purposes. The vehicle sequence at each monitoring station 70 within the intermediate region of the virtual traffic lane 60 is compared to the inlet vehicle sequence, and to the sequence observed at the previous monitoring station. Vehicles having large discrepancies between the initial sequence and the intermediate sequence are flagged for further evaluation, either visually via CCTV surveillance by the Traffic Control Operator, or at the border crossing 80.

Step 11. Traffic exits the virtual traffic lane 60 and is surveyed by the exit monitoring station 68. Monitored information is relayed to the traffic control coordinator 30, where it is both stored and used for traffic control determination purposes. Exit vehicle sequence within the flow of traffic is compared to inlet vehicle sequence, and to the sequence observed at the previous monitoring station. Vehicles having large discrepancies between the initial sequence and the exit sequence are flagged for further evaluation at the border crossing. This information may be stored or archived for further scrutiny or other use by regulatory officials.

Step 12. Unflagged traffic approaches the customs checkpoint 84 at the border 80 and is prepared to cross the border in an expedited fashion.

Step 13. Flagged traffic approaches the customs checkpoint 84 and is stopped to allow further evaluation of the vehicles, cargo, operators, and passengers to determine preparedness to cross the border and address other problems, deviations or deficiencies.

The method allows accommodation for monitoring and controlling the traffic flow of local vehicles, cargo, operators and passengers that are crossing the border and traveling only within the border zone.

Optionally, the method may also the following method steps:

Step 14. Local vehicles pre-register with the traffic control center and are provided a pre-approved status for border crossing.

Step 15. Pre-registered vehicles may report in person to the traffic control center, or may report only electronically to the traffic control coordinator 30.

Step 16. The traffic control coordinator 30 will then accept these reports of preparedness, and remotely release them to the queuing component 28 for scheduling to the virtual traffic lane 60.

Step 17. The queuing component 28 then schedules the release of prepared vehicles into the virtual traffic lane 60. If the local vehicles are close in proximity to the border 80, they may be inserted in an appropriate spot in the queue sequence, and may enter the virtual traffic lane 60 at an intermediate location.

Local traffic then proceeds along the virtual traffic lane 60 and crosses the border per steps 9-13.

The inventive method described herein provides for scheduling releases from the traffic control center 20, or other authorized point of origin within the zone. The scheduled release is provided based on road conditions and availability between the traffic control center 20 and a border 80 within the zone. The method uses the inventive system 10 which provides the ability to accept the electronic (virtual) and physical reporting of those wishing to access the border crossing, whether the reporting vehicles are originating locally or passing through the zone from a distant origin. The method may include continuous surveillance of roadway conditions between the traffic control center 20 and the border 80 for the zone.

The inventive traffic control system 10, including a traffic control center 20 and a virtual traffic lane 60, provides for the secure and monitored passage of vehicles, cargo, operators and passengers through an urban area 90 as they travel along the virtual traffic lane 60 to the border 80. The system 10 allows for expedited passage through a particular zone/territory and ultimately to the foreign (receiving) customs service for the zone/territory. The traffic control system 10 simultaneously controls traffic flow and creates a database of information using various monitoring stations 66, 68 70 along the virtual traffic lane 60, including the point of origin, entry to and exit from the virtual traffic lane 60. The inventive traffic control system 10 improves route security for vehicles, cargo, operators and passengers, without requiring extensive changes to existing roads or lane systems.

Although the present invention has been described herein with respect to a specific illustrative embodiment thereof, the foregoing description is intended to be illustrative, and not restrictive. Those skilled in the art will realize that many modifications of the embodiment could be made which would be operable. All such modifications that are within the scope of the claims are intended to be within the scope and spirit of the present invention.

Having thus described the invention, what is claimed is:

1. A traffic control system for expediting traffic flow at an international border crossing and border inspection station, the traffic control system comprising a traffic control center and a virtual traffic lane, wherein the traffic control center is physically distant from the international border crossing and border inspection station, and the virtual traffic lane comprises a route of travel between the traffic control center and the border, and wherein the virtual traffic lane comprises a plurality of monitoring stations, disposed between the traffic control center and the border crossing, for monitoring traffic conditions along a selected route of travel;

wherein the traffic control center receives traffic bound for the border crossing, the traffic control center monitors and stores data relating to traffic flow between the traffic control center and the border crossing; wherein the traffic control center comprises a screening component and a queuing component;

wherein the screening component determines whether or not a vehicle is prepared to cross the border according to established guidelines, directs prepared vehicles to the queuing component, and directs unprepared vehicles to an area reserved for unprepared vehicles;

and wherein the queuing component provides a sequential ordering for vehicles to advance to the virtual traffic lane.

2. A traffic control system for expediting traffic flow at a border crossing and border inspection station, the traffic control system comprising a traffic control center and a virtual traffic lane, wherein the traffic control center is physically distant from the border crossing and border inspection station, and the virtual traffic lane comprises a route of travel between the traffic control center and the border, wherein the traffic control center receives traffic bound for the border crossing, the traffic control center monitors and stores data relating to traffic flow between the traffic control center and the border crossing; wherein the traffic control center comprises a screening component, a queuing component, and a preparation remediation component; wherein: the screening component determines if a vehicle is prepared to cross the border according to established guidelines, the screening component directing prepared vehicles to the queuing component, and directing unprepared vehicles to the preparation remediation component; the preparation remediation component receives unprepared vehicles and assists in remedying deficiencies in customs information, and wherein when appropriate preparedness is subsequently achieved by a vehicle, the preparation remediation component directs the vehicle to the queuing component; and the queuing component provides a sequential ordering for vehicles to advance to the virtual traffic lane.

3. The traffic control system of claim 2 wherein the virtual traffic lane comprises a plurality of monitoring stations for monitoring traffic conditions along a selected route of travel.

4. The traffic control system of claim 3 wherein a first monitoring station is provided at the entry to the virtual lane, and a final monitoring station is provided at the exit from the virtual lane.

5. The traffic control system of claim 4 wherein each monitoring station comprises a data recorder which is adapted to record data corresponding to the identity of selected vehicles, and to a sequence of said selected vehicles passing the site.

6. The traffic control system of claim 5 wherein the virtual lane comprises at least three monitoring stations.

7. The traffic control system of claim 3 wherein the traffic control center comprises vehicle and cargo information inspection facilities, and wherein an authorized person is available to assist a vehicle in preparing for border crossing.

8. The traffic control system of claim 3 wherein the traffic control center comprises a vehicle staging area sized to allow a plurality of vehicles to stop and park therein and to allow detained vehicles to be stored therein.

9. The traffic control system of claim 8 wherein the traffic control center comprises a service area for providing services and conveniences related to vehicle operation and travel.

10. The traffic control system of claim 3 wherein the screening component comprises a border crossing preparedness check to determine whether the vehicle operator is in possession of proper documentation for crossing an international border, the screening component authorized to facilitate a border crossing for vehicles whose operators are in possession of the proper documentation for crossing an international border.

11. The traffic control system of claim 3 wherein the preparation remediation component comprises providing the service of assisting a vehicle operator to obtain proper documentation and become otherwise prepared for crossing a border.

12. A traffic control system for expediting traffic flow at a border crossing, the traffic control system comprising a traffic control center and a virtual traffic lane, wherein the traffic control center is physically distant from the border crossing, the traffic control center capable of receiving traffic bound for the border crossing, the traffic control center monitoring traffic flow between the traffic control center and the border crossing, and the virtual traffic lane comprising a selected route of travel between the traffic control center and the border crossing;

wherein the virtual traffic lane comprises a plurality of traffic monitoring stations, wherein the control center uses information provided from the monitoring stations of the virtual traffic lane to monitor traffic flow as it approaches the border, the virtual traffic lane receiving traffic flow from the traffic control center.

13. The traffic control system of claim 12 wherein the traffic control center separates traffic bound for the border crossing into at least a first traffic stream and a second traffic stream, wherein the first traffic stream is separate from the second traffic stream.

14. The traffic control system of claim 13, wherein wherein the traffic control center separates traffic bound for the border crossing into three distinct traffic streams, and wherein one of said traffic streams is an expedited electronic processing lane for pre-registered vehicles.

15. The traffic control system of claim 13 wherein the first traffic stream comprises vehicles that are in possession of the proper documentation for approaching a border crossing and crossing a border, and wherein the second traffic stream comprises vehicles that are not in possession of the proper documentation for approaching a border crossing and crossing a border.

16. The traffic control system of claim 13 wherein vehicles in the first traffic stream are directed to a queue in preparation for passing through a border crossing, and wherein vehicles in the second traffic stream are directed to a preparation remediation area and are parked until the vehicle is prepared to cross the border.

17. The traffic control system of claim 16 wherein the traffic control center controls the release of vehicles within the queue into the virtual traffic lane, the ordering of vehicles within the queue related the vehicles' level of preparedness to cross the border.

18. The traffic control system of claim 16, wherein a rate of release of vehicles within the queue into the virtual traffic lane is affected by road availability and conditions between the traffic control center and the border crossing.

19. The traffic control system of claim 18 wherein the road availability and conditions are determined by continuous surveillance of the roads between the traffic control center and the border crossing, using the traffic monitoring stations.

20. The traffic control system of claim 18 wherein the virtual traffic lane is a selected route between the traffic control center and the border crossing, the virtual traffic lane being changeable and selected from a number of available routes, using information obtained from said traffic monitoring stations.

21. A traffic control system for expediting traffic flow across a border which is located adjacent a city, the traffic control system comprising a traffic control center and a virtual traffic lane, wherein the traffic control center is physically distant from the border such that at least a portion of the city resides between the traffic control center and the border, the traffic control center monitoring traffic flow as it passes through at least a portion of the city and approaches the border, and the virtual traffic lane comprising a route of travel between the traffic control center and the border; and wherein the virtual traffic lane comprises a plurality of monitoring stations, disposed between the traffic control center and the border crossing, for monitoring traffic conditions along a selected route of travel, wherein said traffic flow across the border comprises vehicles of local origin and vehicles of non-local origin, the traffic control center remotely controlling the flow of selected vehicles of local origin, and the traffic control center directly controlling the flow of selected vehicles of non-local origin, such that said selected vehicles of non-local origin pass through or physically near the traffic control center;

wherein the traffic control center separates vehicles of non-local origin entering the traffic control center into at least a first traffic stream comprising vehicles that are considered to be ready to cross an international border, and a second traffic stream comprising vehicles that are not considered to be ready to cross an international border, wherein the first traffic stream is separate from the second traffic stream.

22. The traffic control system of claim 21, wherein the control center uses information provided from the monitoring stations of the virtual traffic lane to control traffic flow as it approaches the border, the virtual traffic lane receiving traffic flow from the traffic control center.

23. The traffic control system of claim 21, wherein the virtual traffic lane is a selected route between the traffic control center and the border, the virtual traffic lane being changeable and selected from a number of available routes between the traffic control center and the border.

24. The traffic control system of claim 23, wherein each of said available routes between the traffic control center and the border comprises a plurality of traffic monitoring stations, wherein the control center uses information provided from the monitoring stations to control traffic flow as it approaches the border, the virtual traffic lane receiving the traffic flow from the traffic control center, and wherein the virtual traffic lane is changeable and selected from a number of available routes using information provided from the monitoring stations along said available routes.

25. A method of processing vehicles traveling toward an international border; said method comprising the steps of:

a) providing a traffic control center which is situated a distance apart from an international border;

b) communicating between selected vehicles of border-bound traffic and the traffic control center to determine whether individual vehicles are prepared to cross the border according to a set of guidelines;

c) sorting the vehicles of the selected border-bound traffic into prepared and unprepared vehicles according to said guidelines;

d) arranging a series of the prepared vehicles into a queue;

e) directing the vehicles in the queue to travel along an assigned route defining a virtual lane; and f) monitoring the vehicles in the queue as they travel along the virtual lane using a plurality of monitoring stations.

26. The method of claim 25, further comprising a step of:

g) providing information about the vehicles in the queue to a border crossing authority.

* * * * *